US011147369B2

(12) United States Patent
Dell

(10) Patent No.: US 11,147,369 B2
(45) Date of Patent: Oct. 19, 2021

(54) POINT OF SALE SHELF STACKER DISPLAY

(71) Applicant: Peachtree Packaging, Inc., Lawrenceville, GA (US)

(72) Inventor: Ryan Walker Dell, Loganville, GA (US)

(73) Assignee: Peachtree Packaging, Inc., Lawrenceville, GA (US)

( * ) Notice: Subject to any disclaimer, the term of this patent is extended or adjusted under 35 U.S.C. 154(b) by 0 days.

(21) Appl. No.: 16/740,104

(22) Filed: Jan. 10, 2020

(65) Prior Publication Data

US 2020/0221866 A1 Jul. 16, 2020

Related U.S. Application Data

(60) Provisional application No. 62/790,604, filed on Jan. 10, 2019.

(51) Int. Cl.

| | |
|---|---|
| ***A47B 47/04*** | (2006.01) |
| ***A47F 5/11*** | (2006.01) |
| ***A47F 7/14*** | (2006.01) |

(52) U.S. Cl.

CPC ..... *A47B 47/042* (2013.01); *A47F 5/116* (2013.01); *A47F 7/145* (2013.01); *A47B 2220/0083* (2013.01); *A47F 5/114* (2013.01)

(58) Field of Classification Search

CPC ..... A47F 5/116; A47F 5/105; A47F 7/145; A47F 5/114; A47B 47/042; A47B 2220/0083

See application file for complete search history.

(56) References Cited

U.S. PATENT DOCUMENTS

| | | | | |
|---|---|---|---|---|
| 4,723,664 | A * | 2/1988 | Smith | A47F 1/08 211/149 |
| 6,715,623 | B2 * | 4/2004 | Broerman | A47F 5/116 211/149 |
| 7,007,615 | B2 * | 3/2006 | Grueneberg | A47B 43/02 108/165 |
| 7,374,047 | B2 * | 5/2008 | Bryson | A47F 5/116 108/107 |
| 7,677,433 | B2 * | 3/2010 | Little | B65D 5/526 229/120.15 |
| 8,317,039 | B2 * | 11/2012 | Norman | A47F 5/118 211/60.1 |
| 9,211,021 | B2 * | 12/2015 | Smith | A47F 5/116 |
| 9,844,281 | B2 * | 12/2017 | Fernandez | A47B 47/0008 |

(Continued)

*Primary Examiner* — Ko H Chan

(74) *Attorney, Agent, or Firm* — Smith Tempel Blaha LLC; Matthew T. Hoots

(57) ABSTRACT

A point of sale shelf stacker display system has a front wall with a plurality of apertures and cross-bars. The rear wall supports one or more tab locking systems. The system further includes two side walls coupled to the front wall and the rear wall. The tab locking systems may receive a tab from a shelf. The shelf is supported by a cross-bar and at least one tab locking system. The shelf may include a front facing member which wraps around a respective cross-bar. Each tab locking system may include an upper slot and a lower slot positioned within the rear wall. Each tab from the shelf may exit an upper slot and may enter a lower slot. The shelf having at least one tab may be made from a single sheet of material.

5 Claims, 20 Drawing Sheets

(56) References Cited

U.S. PATENT DOCUMENTS

| | | | | |
|---|---|---|---|---|
| 10,568,422 | B2 * | 2/2020 | Gibbons, Jr. | A47B 43/02 |
| 2004/0148825 | A1 * | 8/2004 | Myers | A47F 5/116<br>40/124 |
| 2011/0000955 | A1 * | 1/2011 | Manteufel | B65D 5/728<br>229/103 |
| 2018/0289178 | A1 * | 10/2018 | McMillan-Sweat | A47F 5/116 |
| 2019/0159608 | A1 * | 5/2019 | Kistner | B65D 5/4204 |

* cited by examiner

POINT OF SALE SHELF STACKER DISPLAY

BACKGROUND

The present invention relates to corrugated packaging and display solutions and, more particularly, to an improved point of sale shelf stacker display. Prior art solutions for shelf stacker displays have suspect structural rigidity and so require the use of support posts between shelves. Additionally, prior art solutions for shelf stacker displays are limited in the minimum distance possible between adjacent shelves because the method for folding/constructing prior art designs requires adjacent shelves to be far enough apart that the distance can accommodate the folding through of a shelf bottom. For this reason, prior art designs cannot place adjacent shelves any closer together than roughly a distance dictated by the depth of a shelf.

The need to use support posts in prior art designs adds costs to the display, complicates folding and construction of the display, and encroaches on shelf space better utilized for product presentation. Moreover, the limitation in prior art designs with regard to the minimum possible distance between adjacent shelves limits the amount product, type of product, and visual presentation of product possible at the point of sale. Therefore, there is a need in the art for a point of sale shelf stacker display that exhibits strong structural rigidity without the need for support posts. Further, there is a need in the art for a point of sale shelf stacker display in which shelf depth does not dictate the minimum distance between adjacent shelves.

SUMMARY

Exemplary embodiments of a point of sale shelf stacker display according to the solution are disclosed. Certain embodiments may be constructed from a corrugated material, such as a cardboard, although it is envisioned that embodiments of the solution may be constructed from any material that can be die-cut or otherwise converted into a foldable template. Advantageously, because of the novel template design and folding method, embodiments of the solution exhibit strong structural rigidity without the need to include support posts between shelves and also enable designers to place shelves relatively closer together than prior art designs.

According to one exemplary embodiment, a point of sale shelf stacker display system has a front wall with a plurality of apertures and cross-bars. The rear wall supports one or more tab locking systems. The system further includes two side walls coupled to the front wall and the rear wall. The tab locking systems may receive a tab from a shelf. The shelf is supported by a cross-bar and at least one tab locking system.

The shelf may include a front facing member which wraps around a respective cross-bar. Each tab locking system may include an upper slot and a lower slot positioned within the rear wall. Each tab from the shelf may exit an upper slot and may enter a lower slot. The shelf having at least one tab may be made from a single sheet of material. The front wall may also have a kick plate and a cross-bar adjacent to the kick plate which is formed by two members. The front wall with apertures, cross-bars, the rear wall, and two side walls may be made from a single sheet of material.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Various embodiments, aspects and features of the present invention encompass a system and method for constructing a point of sale shelf stacker display from flat templates of a perforable and foldable material such as, but not limited to, a corrugated cardboard. Advantageously, because embodiments of the solution are constructed from flat components made of corrugated cardboard (or similar material) that has been die-cut, perforated and/or creased according to templates, the components may be inexpensively and efficiently shipped in their flat forms before being folded and integrated together on-site to form an improved point of sale shelf stacker display.

Additionally, and advantageously over prior art solutions, due to the novel design and construction of embodiments of the solution, a point of sale shelf stacker display according to the solution may be particularly robust with significant structural rigidity suitable for carrying a relatively heavy payload without the need for support posts between shelves. Moreover, and also advantageously over prior art solutions, due to the novel design and construction of embodiments of the solution, a point of sale shelf stacker display according to the solution may afford designers with the ability to place adjacent shelves relatively close together, if so desired by the designer, because the method of folding and constructing shelves within the body of the stacker does not require that the distance between shelves be large enough to accommodate "folding through" of a shelf's bottom surface.

Figure 1:
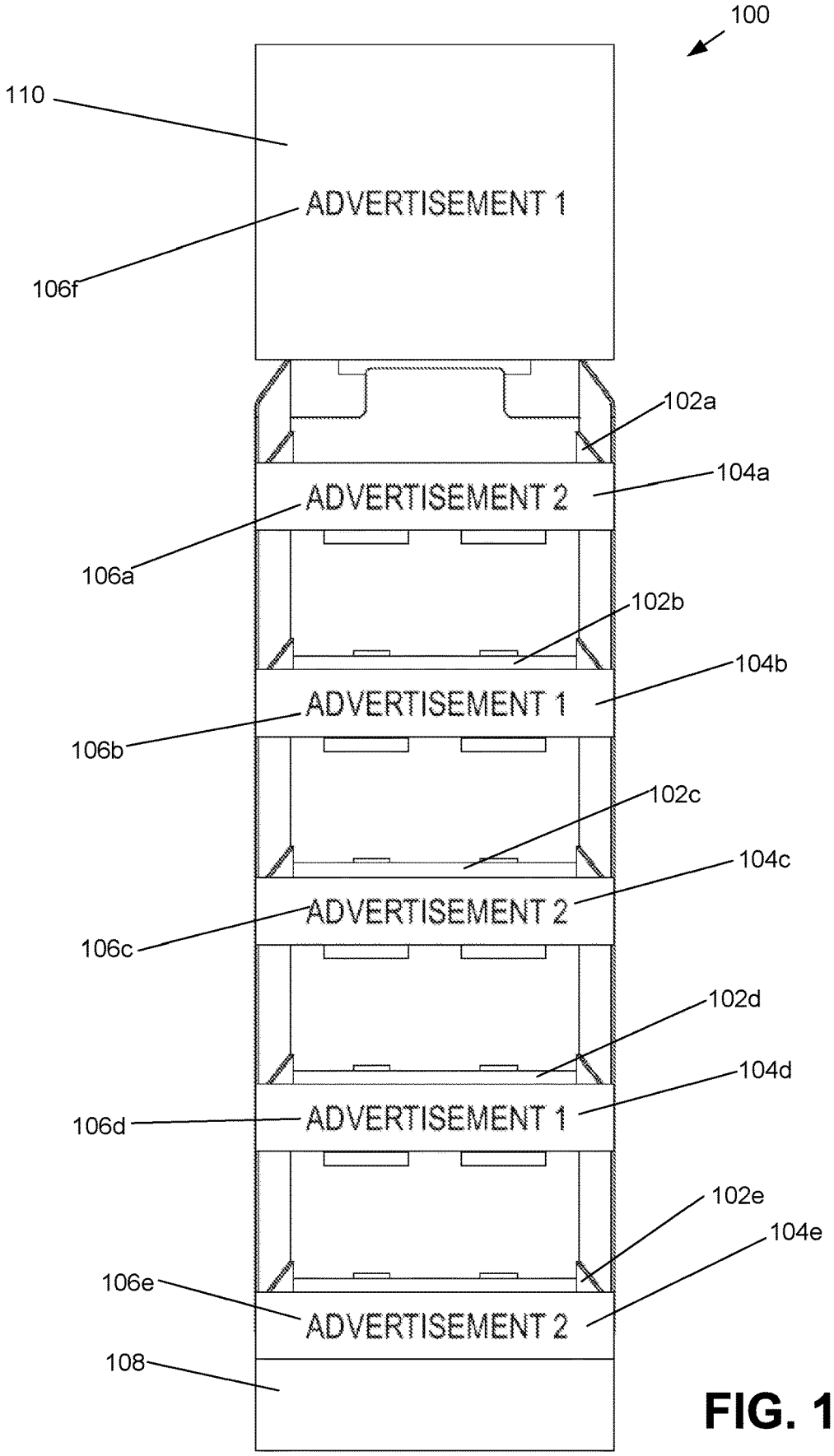
FIG. 1 illustrates a front, perspective view of a point of sale shelf stacker display according to one exemplary embodiment of the invention.

Referring now to FIG. 1, this figure illustrates a front, perspective view of a point of sale shelf stacker display 100 according to one exemplary embodiment of the invention. As can be understood from FIG. 1, the exemplary shelf stacker display 100 may be constructed from a corrugated cardboard material, as mentioned above. However, other materials are possible and are included within the scope of this disclosure. Other materials could include wood, metal, composites, corrugated plastic sheets, plastic sheets, etc.

The shelf stacker display 100 may comprise one or more shelves 102. In the exemplary embodiment illustrated in FIG. 1, there are five shelves 102*a*, 102*b*, 102*c*, 102*d*, and 102*e*. Fewer or additional shelves 102 may be provided without departing from the scope of this disclosure. Each shelf 102 may further comprise a front facing member 104. Each front facing member 104 may be formed from a plurality of layers of materials which will be described in further detail below.

Each front facing member 104 may bear or support printed material and/or engraved materials 106. These printed or engraved materials 106 may comprise a form of advertising which may include, but art not limited to, text, graphics or a combination thereof. In the exemplary embodiment illustrated in FIG. 1, front facing members 104*b* and 104*d* have printed or engraved materials 106*b* and 106*d* which comprise the word "Advertisement 1."

Meanwhile, front facing members 104*a*, 104*c*, and 104*e* have printed or engraved materials 106*a*, 106*c*, 106*e* which comprise the word "Advertisement 2." While not illustrated, each of the front facing members 104 may have identical printed or engraved materials 106, or in other cases, each front facing member 104 may have a different printed or engraved material 106.

As illustrated in FIG. 1, the shelf stacker display 100 may further comprise an upper display plate 110 and a lower kick plate 108. The lower kick plate 108 may provide support for the entire structure. Meanwhile, the upper display plate 110 may provide a surface for bearing another printed and/or engraved material 106*f* In the exemplary embodiment of FIG. 1, the printed and/or engraved material 106*f* for the upper display plate 110 may comprise the word "Advertisement 1." The kick plate 108 may also support printed or engraved materials 106 (though not shown in FIG. 1).

Figure 2:
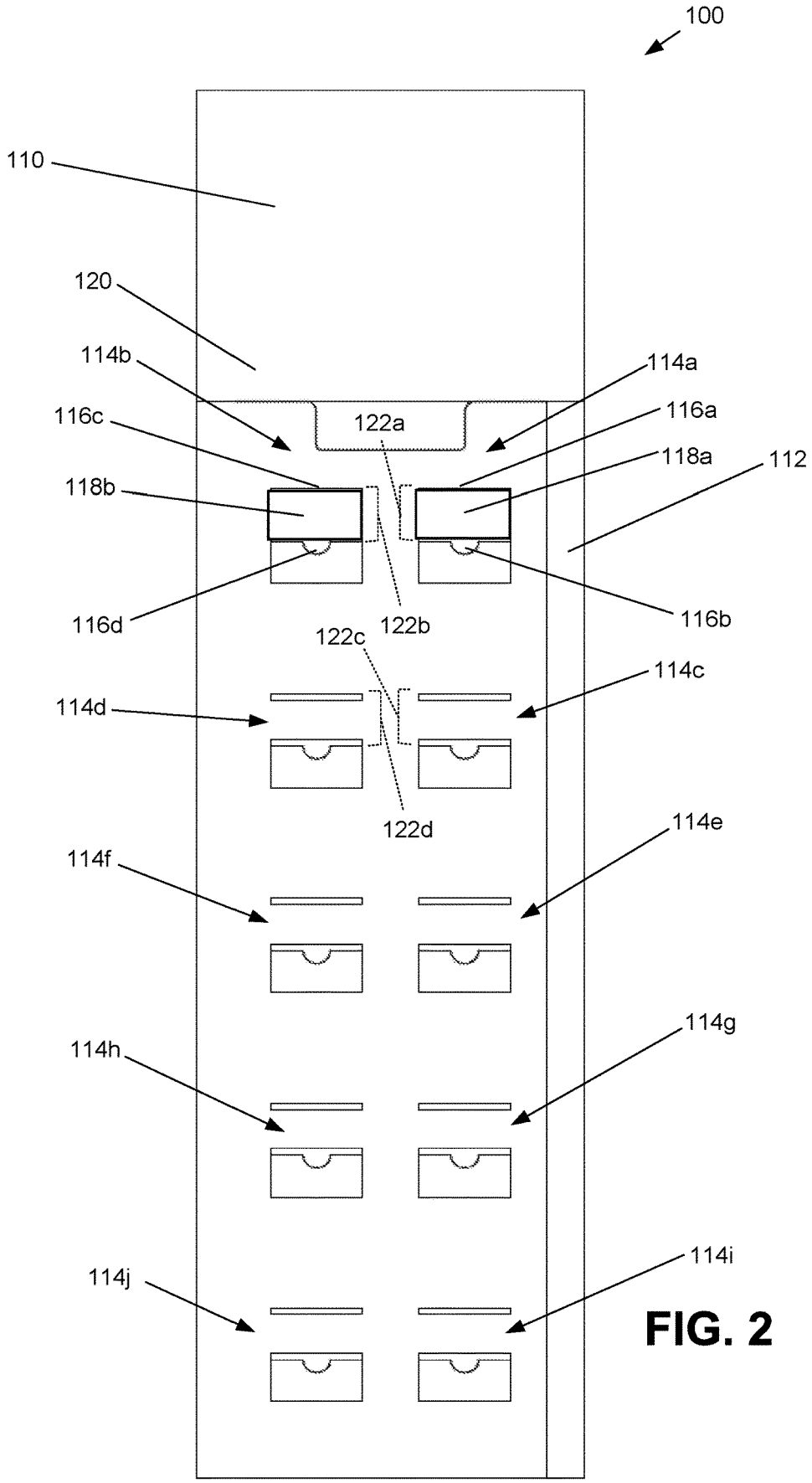
FIG. 2 illustrates a rear, perspective view of the point of sale shelf stacker display of FIG. 1 according to one exemplary embodiment of the invention.

Referring now to FIG. 2, this figure illustrates a rear, perspective view of the point of sale shelf stacker display 100 of FIG. 1, but in a partially assembled state according to one exemplary embodiment of the invention. As illustrated in FIG. 2, a rear view of the upper display plate 110 is shown as well as a rear seam 112. The rear seam 112 is fastened/coupled along a rear wall 120.

Usually, the rear seam 112 is fastened/coupled to the rear wall using an adhesive. However, other fasteners are possible and are included within the scope of this disclosure. For example, in addition to or in the alternative to an adhesive, mechanical fasteners (not shown) such as staples and/or plastic rivets could be employed to attach rear seam 112 to rear wall 120.

The rear wall 120 may also support several locking tab systems 114. That is, each shelf 102 of FIG. 1 may form part of the locking tab systems 114 present on the rear wall 120 of the shelf stacker display 100. Specifically, each shelf 102 may comprise a pair of locking tabs 118 that form portions of the locking tab system 114. It is noted that FIG. 2 shows a partially assembled state for the shelf stacker display 100 because only the first shelf 102*a* is illustrated as assembled in FIG. 2. This means that the second through fifth shelves 102*b*-102*e* are not illustrated in FIG. 2 for brevity and for explaining how each shelf 102 and its respective pair of locking tabs 118 form part of each locking tab system 114 shown in FIG. 2.

Each locking tab system 114 of FIG. 2 may comprise a locking tab 118, and a first slot 116 and a second slot 116. However, only the first and second locking tab systems 114*a*, 114*b* are shown with locking tabs 118. The third through tenth locking tab systems 114*c*-114*j* are not provided with any locking tabs 118 which are part of respective shelves 102. Thus, FIG. 2 shows the shelf stacker display 100 in a partially assembled state because only the first shelf 102 and its two locking tabs 118 are shown in FIG. 2. Meanwhile, the locking tabs 118 for the second through fifth shelves 102*b*-102*e* are not shown in FIG. 2.

The first locking tab system 114*a* corresponding to the first shelf 102*a* of FIG. 1 may comprise a first locking tab 118*a*, a first slot 116*a*, and second slot 116*b*. The second slot 116*b* may further comprise a semicircular aperture that may allow for easier tucking of the first locking tab as will be described in more detail below. The first and second slots 116*a* and 116*b* further define a first rectangular section 122*a* on the rear wall 120.

The second locking tab system 114*b* may also correspond to the first shelf 102*a* of FIG. 1 and it may comprise a second locking tab 118*b*, a first slot 116*c*, and second slot 116*d*. The second slot 116*d* may further comprise a semicircular aperture that may allow for easier tucking of the second locking tab 118*b*. The first and second slots 116*c* and 116*d* of the second locking tab system 114*b* further define a second rectangular section 122*b* on the rear wall 120.

During assembly of the first shelf 102*a*, the first and second locking tabs 118*a*, 118*b* (which are part of first shelf 102*a*) first extend through the first slots 116*a*, 116*c* in a direction out of the page and then they are wrapped around respective rectangular sections 122*a*, 122*b* and then the tabs 118*a*, 11*b* are then inserted into the respective second slots 116*b*, 116*d*, into the page. That is, the first locking tab 118*a* first extends through first slot 116*a* out of the page and then is wrapped around rectangular section 122*a* and then it is inserted into the second slot 116*b* into the page.

Similarly, the second locking tab 118*b* first extends through first slot 116*c* out of the page and then is wrapped around rectangular section 122*b* and then it is inserted into the second slot 116*d* into the page. The first and second locking tabs 118*a*, 118*b* are/form part of the first shelf 102*a* of FIG. 1. Further details of the locking tab systems 114 will be described below in connection with FIGS. 15-17.

Each shelf 102 of FIG. 1 has a corresponding pair of locking tab systems 114. So this means, the first shelf 102*a* has the first and second locking tab systems 114*a*, 114*b*; the second shelf 102*b* has the third and fourth locking tab systems 114*c*, 114*d*; the third shelf 102*c* has the fifth and sixth locking tab systems 114*e*, 114*f*; the fourth shelf 102*d* has the seventh and eighth locking tab systems 114*g*, 114*h*; and the fifth shelf 102*e* has the ninth and tenth locking tab systems 114*i*, 114*j*. As noted above, the tabs 118 which are part of each shelf 102 are not shown in FIG. 2 for the third through tenth locking tab systems 114*c*-114*j* for brevity; however, see FIG. 4 (described below) for a fully assembled view of the shelf stacker display 100 which does illustrate all tabs 118 for each locking tab system 114.

Figure 3:
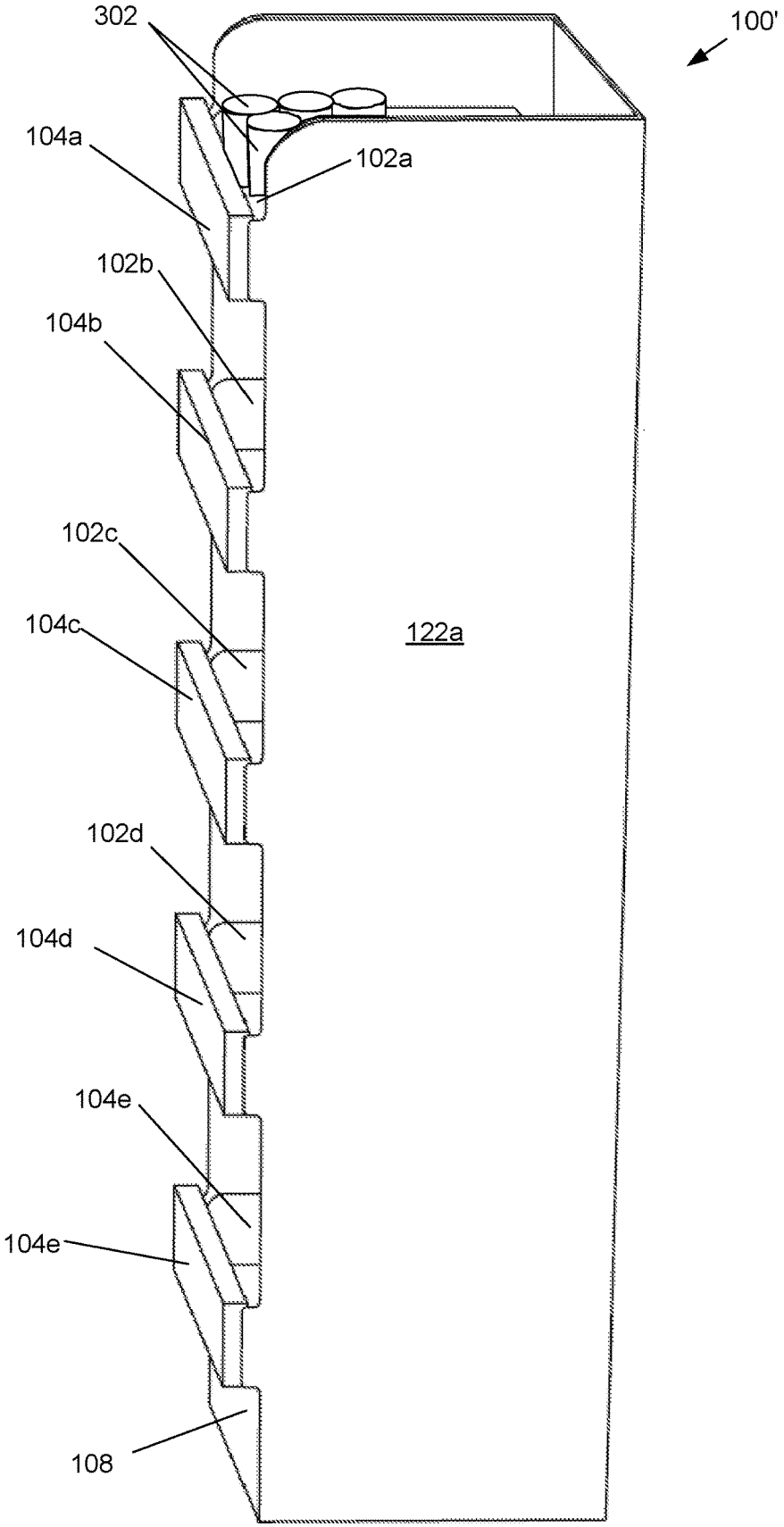
FIG. 3 illustrates a perspective, side view of the point of sale shelf stacker display of FIG. 1 according to one exemplary embodiment of the invention.

Referring now to FIG. 3, this figure illustrates a perspective, side view of the point of sale shelf stacker display 100' according to one exemplary embodiment of the invention. According to this exemplary embodiment of the invention, the upper display plate 110 has been removed. This view illustrates some relative thickness details for the front facing members 104 that are provided for each shelf 102. Also illustrated is a side wall 122*a*.

FIG. 3 also shows the first shelf 102 supporting a plurality of objects 302. According to one exemplary embodiment, these objects 302 may comprise beverages contained within containers, such as aluminum cans. As one of ordinary skill in the art will appreciate, beverages are usually in the form of liquids and liquids other than water can also produce a significant amount of weight when contained within containers. As noted in the background section of this disclosure, the inventive system 100 may support numerous objects 302, which may comprise beverages, and the inventive system 100 does not need any additional support structures other than what is illustrated in the several figures of this disclosure.

Beverages contained within aluminum cans may produce a significant amount of weight and such weight can be difficult for other prior art cardboard shelves to handle—especially prior art solutions which require additional supports beyond cardboard—such as wood and/or metal beams and the like—which is opposite to and unlike the present inventive system 100. The inventive system 100 may easily support four six-packs (usually termed "a case") of aluminum cans 302 per shelf 102 as understood by one of ordinary skill in the art. Other volumes of objects 302 are possible and are included within the scope of this disclosure.

The objects 302 are not limited to containers filled with beverages. The containers may be filled with any liquids, including water. Further, the containers may also be other types of containers compared to aluminum cans. For example, other containers may be made from glass, plastics, and other materials and any combination of materials. Further, the objects 302 are not limited to containers. The objects 302 may comprise any product available for purchase and display and which are usually shelved in a store front. Other objects include, but are not limited to, food stuffs, like fruit, other solid objects like tools, and any other manufactured products which are capable of being held in a human hand, and the like.

Figure 4:
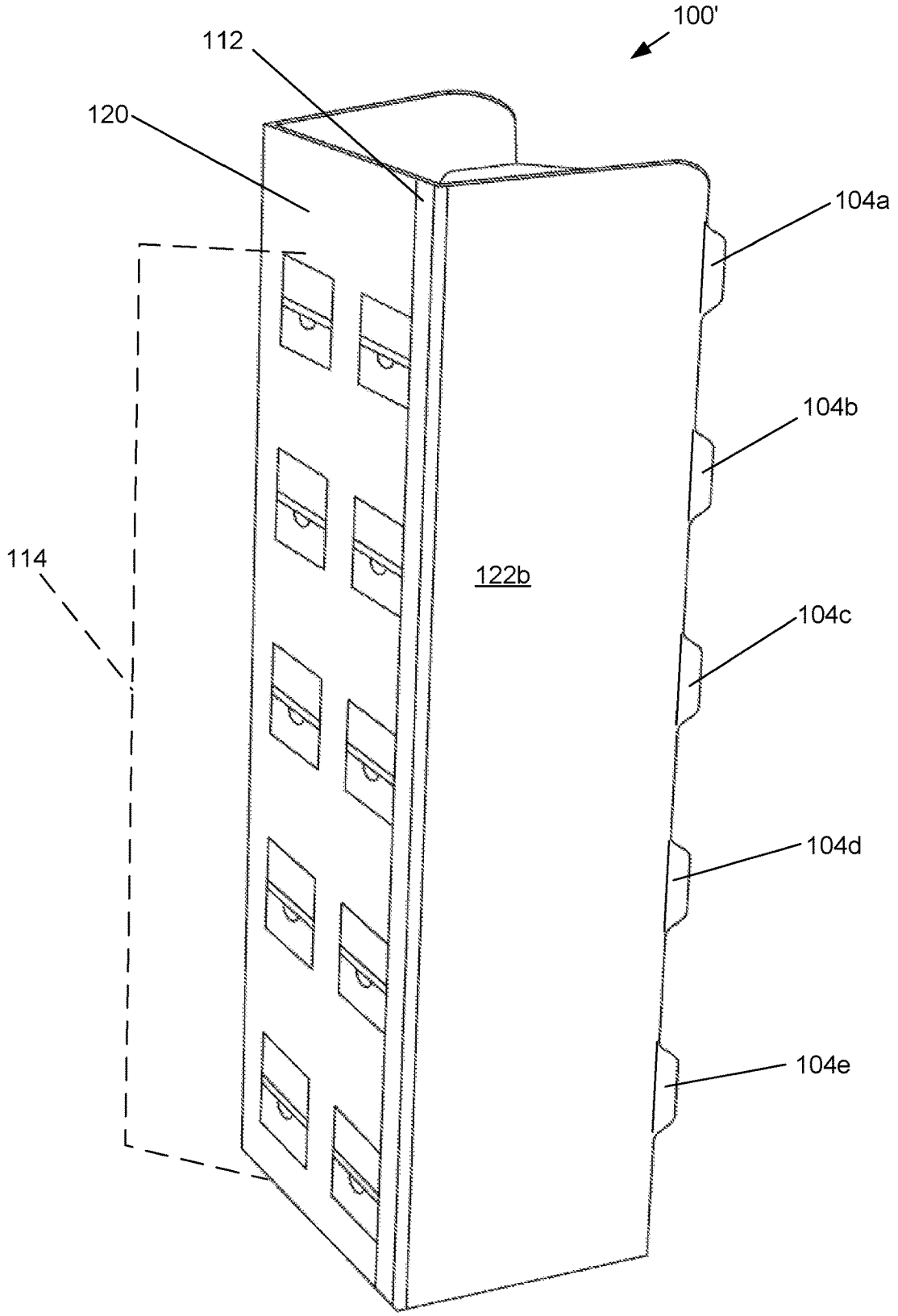
FIG. 4 illustrates another yet different perspective, side view of the point of sale shelf stacker display of FIG. 3 according to one exemplary embodiment of the invention.

Referring now to FIG. 4, this figure illustrates another yet different perspective, side view of the point of sale shelf stacker display 100' of FIG. 3 according to one exemplary embodiment of the invention. Like the exemplary embodiment of FIG. 3, the upper display plate 110 has been removed. In this view, the rear seam 112 that is coupled to the rear wall 120 is visible. This view also illustrates the several locking tab systems 114 that are provided for each shelf 102 having a front facing member 104. As described above, each shelf 102 and front facing member 104 has two locking tab systems 114 provided on the rear wall 120. Also illustrated is a side wall 122*b* which is coupled to the rear seam 112. Compared to FIG. 2, FIG. 4 shows the shelf stacker display 100' in a fully assembled state since the locking tabs 118 from each shelf 102 is illustrated on the rear wall 120. One other difference when comparing FIG. 4 to FIG. 2, is that the exemplary embodiment shown in FIG. 4 does not have the upper display plate 110, which is optional, and is illustrated in FIG. 2.

Figure 5:
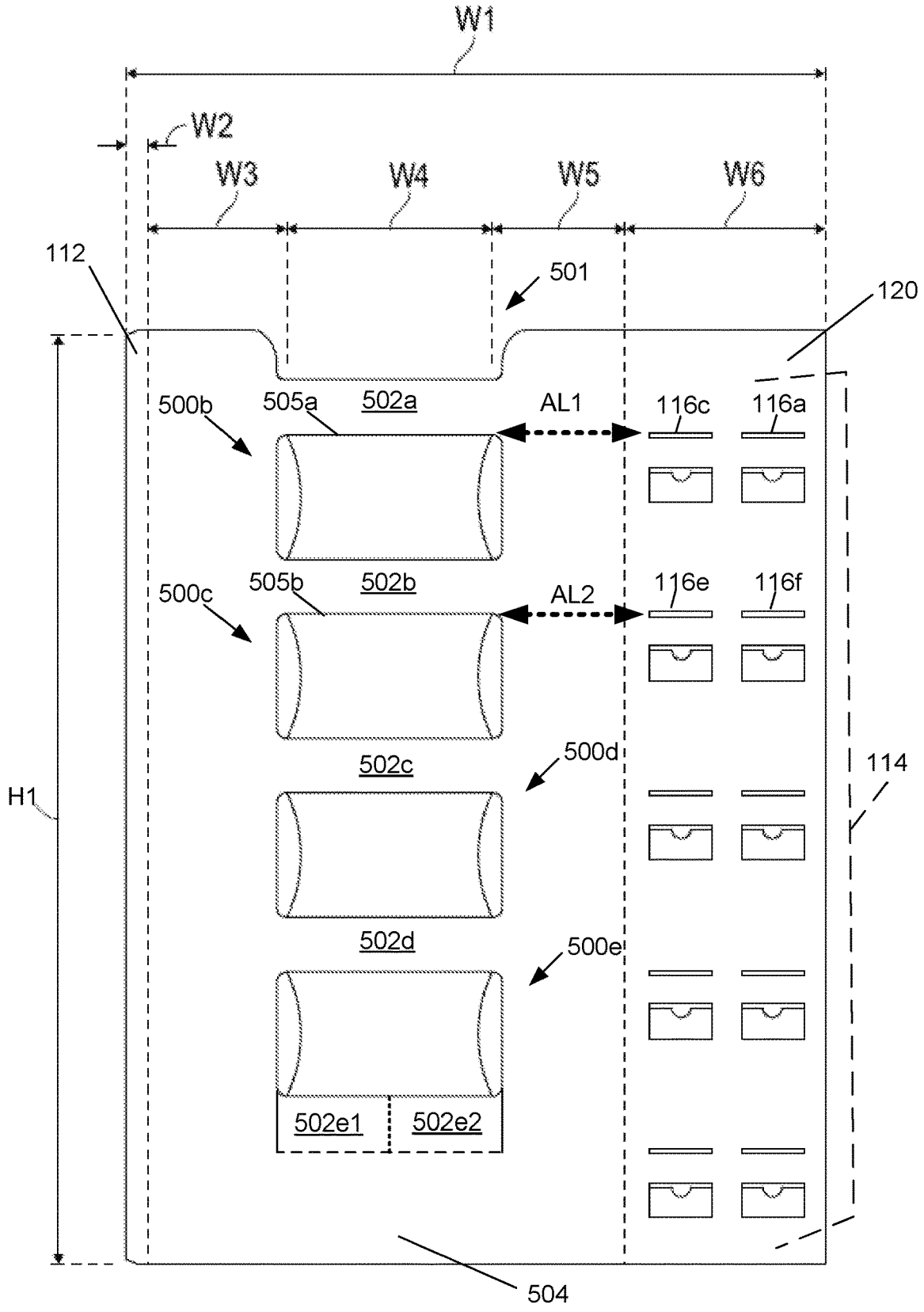
FIG. 5 illustrates a die-cut template drawing for the shelf stacker display but without any of the shelves.

Referring now to FIG. 5, this figure illustrates a die-cut template drawing for the shelf stacker display 100 but without any of the shelves 102. The locking tab systems 114 (that include slots 116) are visible in FIG. 5. And because there are no shelves 102 as part of the die-cut template, then the locking tabs 118 described previously are also not presented in this view.

FIG. 5 illustrates five cross bars 502*a*-502*e* on which the five front facing members 104 of shelves 102 (not shown, but see FIG. 1) attach. FIG. 5 illustrates a region 501 that will be occupied by the first, open top shelf 102*a* (not visible in FIG. 5, but see FIG. 1 and FIG. 19). FIG. 5 further illustrates four apertures 500*b*-500*e* the receive the second through fifth shelves 102*b*-102*e* (not visible in FIG. 5, but see FIG. 1). The four apertures 500*b*-500*e* and cross-bars 502 define a front wall of the display 100. FIG. 5 further illustrates how the lower edge 505 of each cross-bar 502 aligns with the first two slots 116 of two respective locking tab systems 114.

As just two examples for the five cross-bars 502*a*-502*e* and their alignment with the locking tab systems 114, the lower edge 505*a* of the first cross-bar 502*a* aligns with upper slots 116*c*, 116*a* of the first two locking tab systems 114 as shown by alignment arrow AL1. Similarly, the lower edge 505*b* of the second cross-bar 502*b* aligns with upper slots 116*e*, 116*f* of the second two locking tab systems 114 as shown by alignment arrow AL2.

Figure 19:
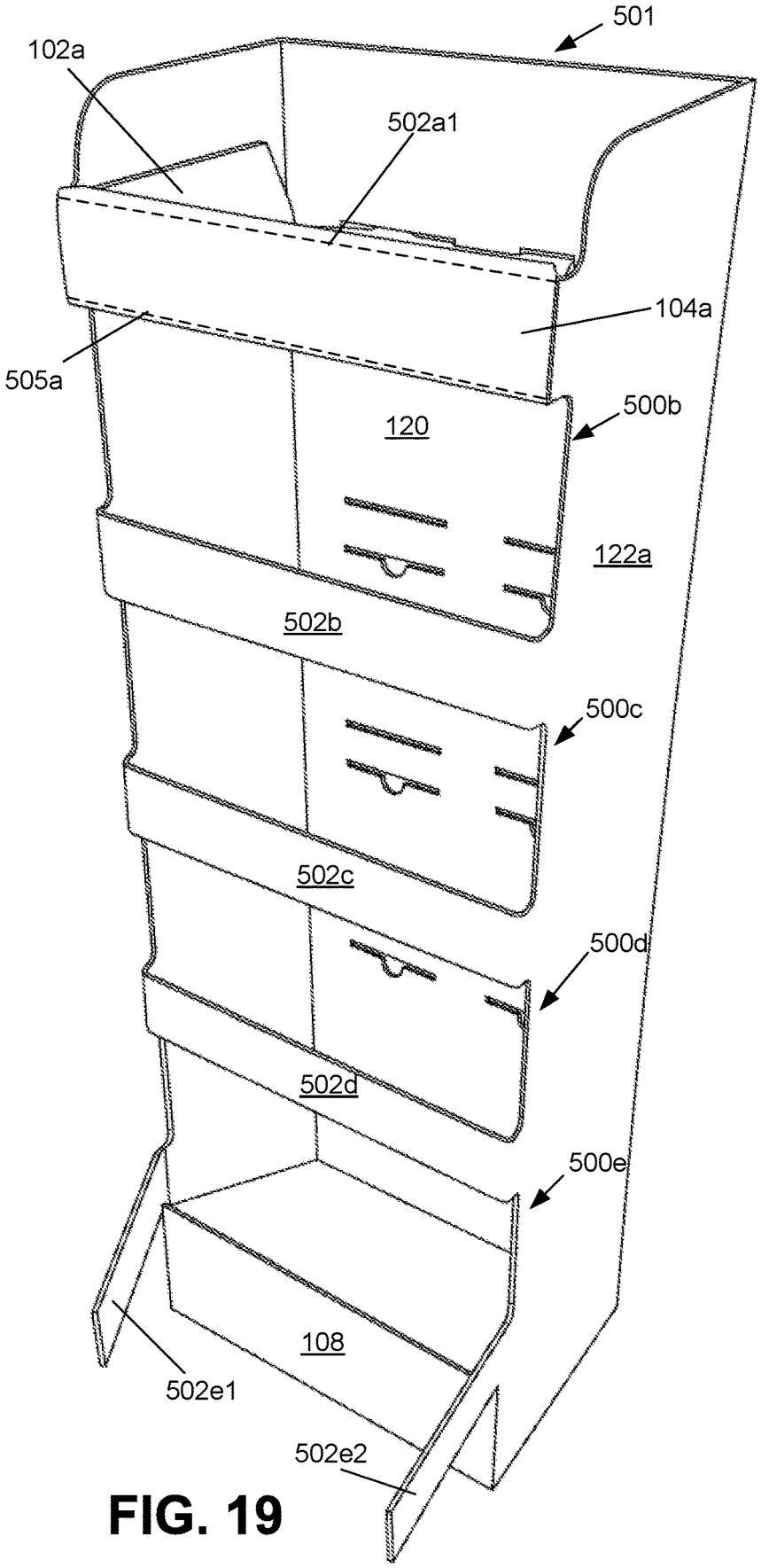
FIG. 19 illustrates a side, perspective view of the shelf stacker display in a partially assembled state.

FIG. 5 further illustrates how the lower cross-bar 502*e* is separated into two portions 502*e*1 and 502*e*2. This separation of the lower cross-bar 502*e* into two portions 502*e*1 and 502*e*2 is made so that the fifth shelf 102*e* may be inserted into aperture 500*e* and so that the front facing member 104*e* of the fifth shelf 102*e* may be wrapped around the lower cross-bar 502*e*. Referring briefly to FIG. 19, this figure illustrates the FIG. 5 further illustrates apertures 500*a*-500*e* through which the shelves 102 are inserted as will be described below. FIG. 5 further illustrates how the fifth cross-bar 502*e* may be cut/perforated/separated into two sections along dotted line 504. See FIG. 19 described in further detail below, and which shows a side, perspective view of the shelf stacker display 100 in a partially assembled state.

Specifically, FIG. 19 only shows the top, first and only open shelf 102*a* installed where its front facing member 104*a* wraps around the first cross-bar 502*a* shown with dashed lines 505*a*, 502*a*1 since it is hidden from actual view when the front facing member 104*a* is present. FIG. 19 further illustrates how the fifth cross-bar 502*e* is separated into its two sections 502*e*1 and 502*e*2 so that the fifth shelf 102*e* may be received and its front facing member 104*e* can wrap around the two sections 502*e*1, 502*e*2.

Referring now back to FIG. 5, this figure further illustrates exemplary dimensions for the seam 112, apertures 500*b*-*e* through which the shelves 102 (not shown) are inserted, as well as dimensions for the rear wall 120. Other dimensions larger or smaller than these exemplary dimensions are possible and are included within the scope of this disclosure.

The exemplary dimensions listed in FIG. 5 are as follows: dimension W1=about 52.00 inches; W2=about one and three-quarter inches; W3=about ten and five-sixteenth inches; W4=about fifteen and one-sixteenth inches; W5=about ten and one-sixteenth inches; W6=about fourteen and three-quarter inches; and H1=about forty-seven and one-quarter inches.

Figure 6:
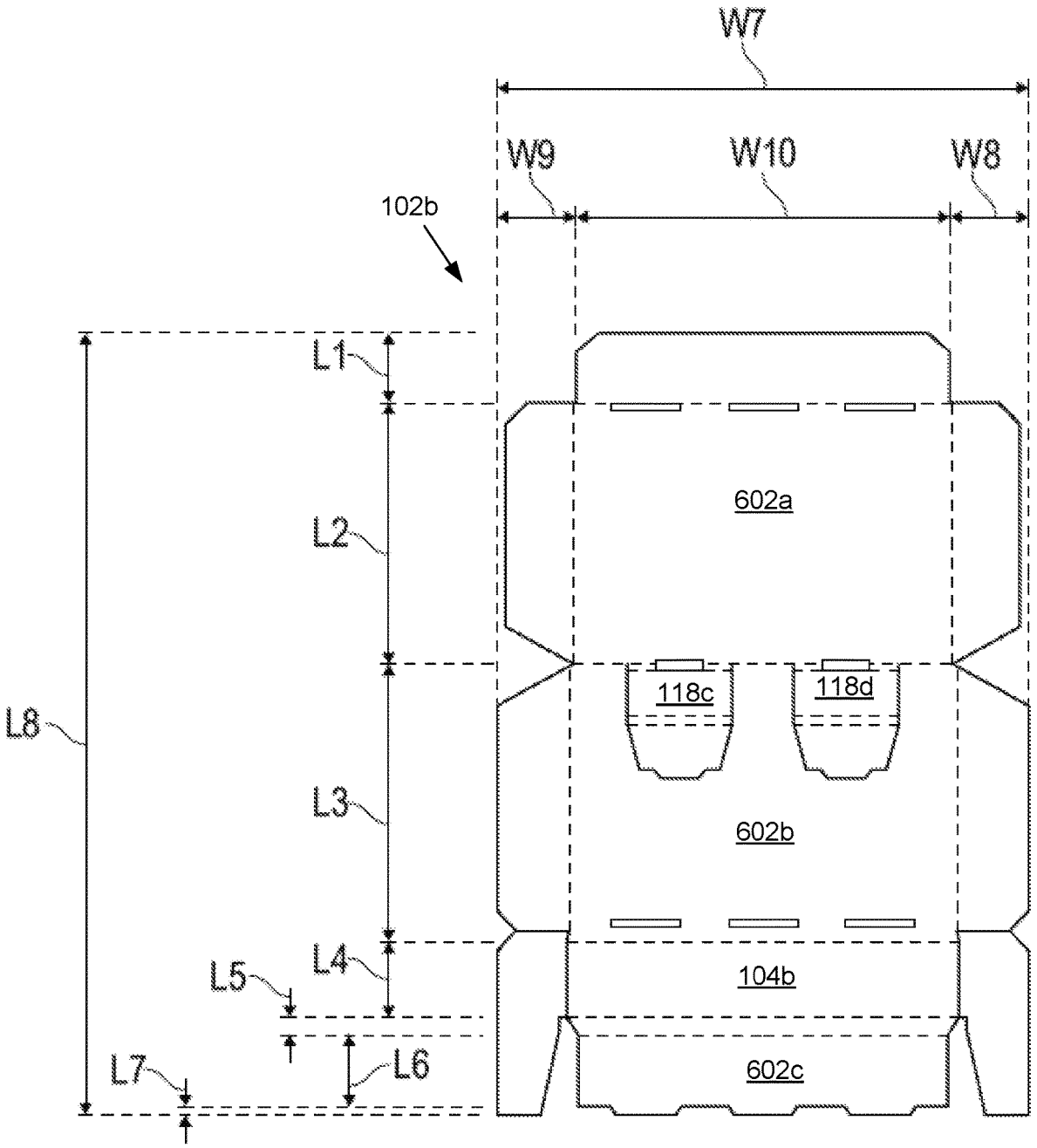
FIG. 6 illustrates a die-cut template drawing for each shelf according to an exemplary embodiment.

Referring now to FIG. 6, this figure illustrates a die-cut template drawing for each shelf 102 according to an exemplary embodiment. FIG. 6 further illustrates that each shelf 102 may comprise a first panel member 602*a*, a second panel member 602*b*, and a third panel member 602*c* which are folded together. For brevity, the shelf 102 of FIG. 6 will be referred to as the second shelf 102*b* since later figures in this disclosure illustrate how shelves 102 are inserted into apertures 500*b*-500*e* (not shown). Each shelf 102 further includes tabs 118*c*, 118*d* and front facing member 104*b*.

As shown in FIG. 6, front facing member 104*b* is actually facing downward into the page as will become apparent to one of ordinary skill in the art after viewing FIGS. 10-13 which illustrate a sequence of how the elements of each shelf 102 are folded together. This folding and layering of panel members for each shelf are what provide for increased strength and durability. As noted previously, one advantage of the inventive system 100 is that rear support members are not needed for the inventive system compared to prior art systems.

FIG. 6 further illustrates exemplary dimensions for the panel members 602*a*-602*c* as well as the front facing member 104*b*. Other dimensions larger or smaller than these exemplary dimensions are possible and are included within the scope of this disclosure.

The exemplary dimensions listed in FIG. 6 are as follows: dimension W7=about twenty and three-sixteenth inches; W8=W9=about two and three-quarter inches; W10=about fourteen and five-eighth inches; L1=about two and nine-sixteenth inches; L2=about nine and eleven-sixteenth inches; L3=about ten and three-sixteenth inches; L4=about two and seven-eighth inches; L5=about eleven-sixteenths of an inch; L6=about two and five-eighths inches; L7=about five-sixteenths of an inch; and L8=about twenty eight and seven-eighth inches.

Figure 7:
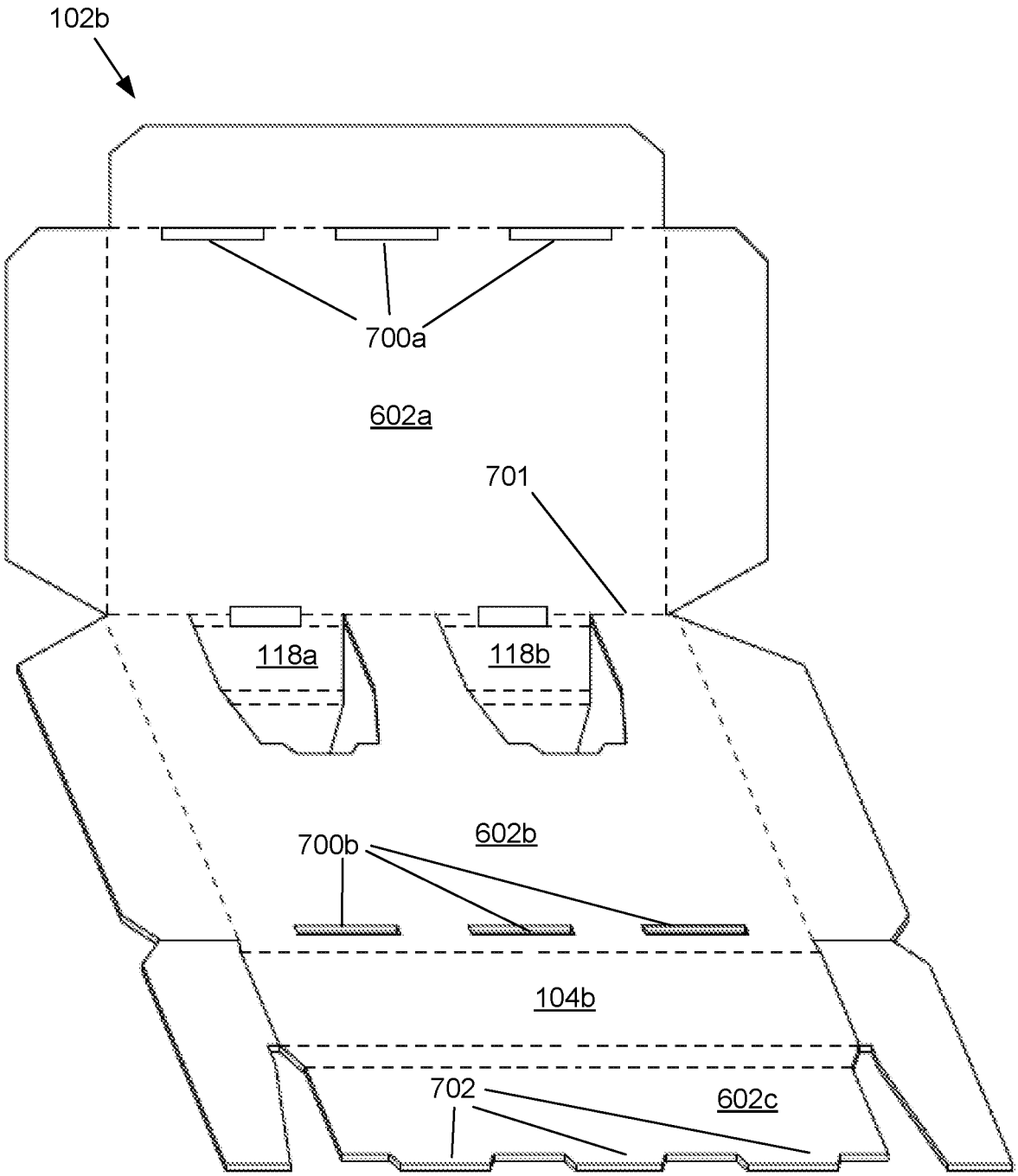
FIG. 7 illustrates a perspective view of the second shelf in a partially assembled state relative to the state illustrated in FIG. 6.

Referring now to FIG. 7, this figure is a perspective view of the second shelf 102*b* in a partially assembled state relative to the state illustrated in FIG. 6 according to an exemplary embodiment. In this exemplary embodiment, the first panel member 602*a* has been rotated almost ninety degrees about a seam 701 relative to its position shown in FIG. 6. Further, tabs 118*a*, 118*b* have also been rotated ninety degrees relative to their position shown in FIG. 6, but the tabs 118*a*, 118*b* have been rotated in a direction opposite to the direction of rotation made by the first panel 602*a*.

The first panel member 602*a* has a series of three slots 700*a*. Meanwhile the second panel 602*c* has a second set of three slots 700*b*. And the third panel 602*c* has a set of tabs 702. The relationship between the slots 700*a*, 700*b* and tabs 702 will become more apparent in connection with the later figures.

Figure 8:
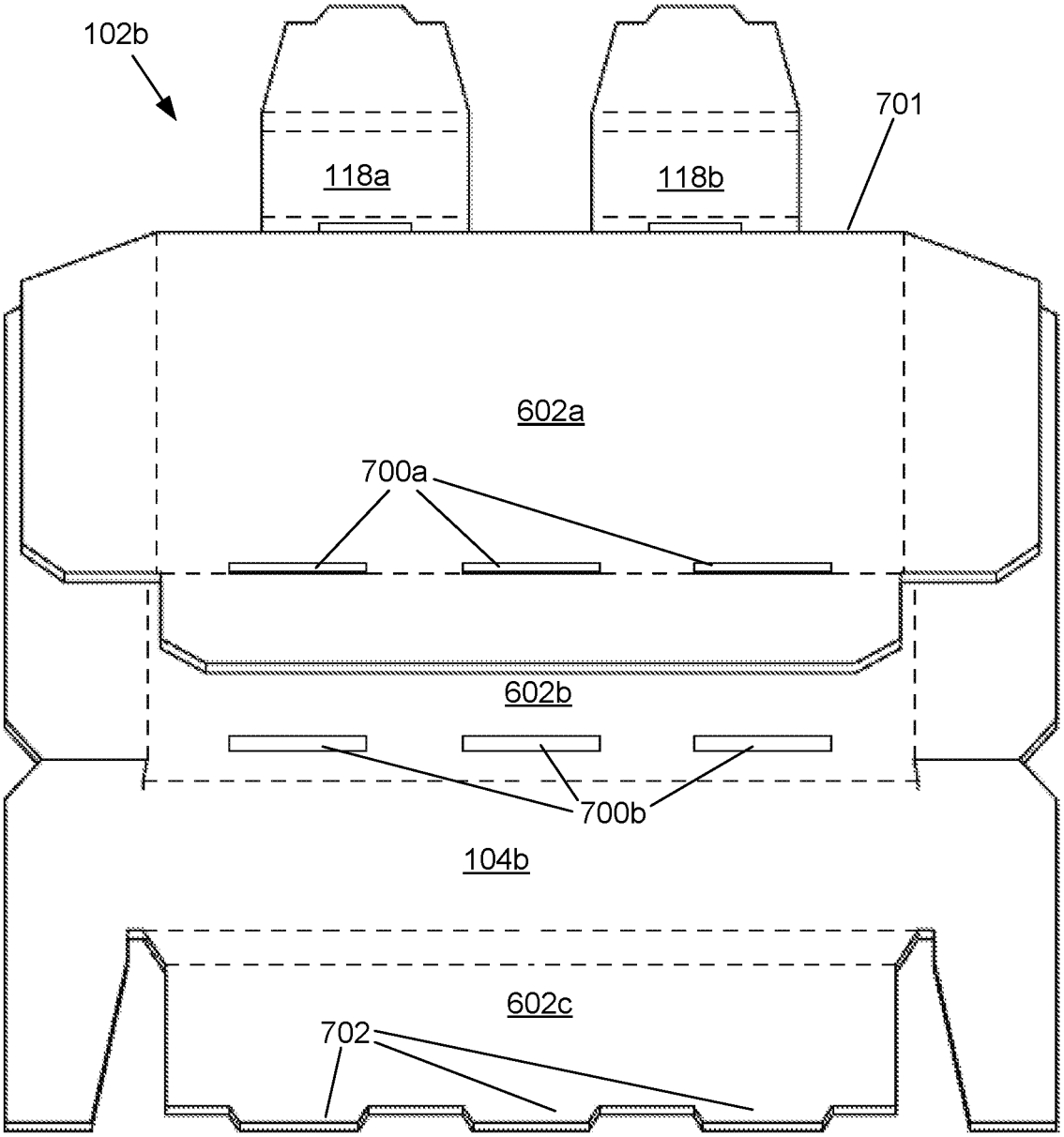
FIG. 8 illustrates a perspective view of the second shelf in a partially assembled state relative to the state illustrated in FIG. 7.

Referring now to FIG. 8, this figure is a perspective view of the second shelf 102*b* in a partially assembled state relative to the state illustrated in FIG. 7 according to an exemplary embodiment. In this exemplary embodiment, the first panel member 602*a* has continued its rotation around seam 701 such that it almost covers the second panel 602*b*. The first set of slots 700*a* of the first panel 602*a* are almost in alignment with the second set of slots 700*b* of the second panel 602*b*.

Figure 9:
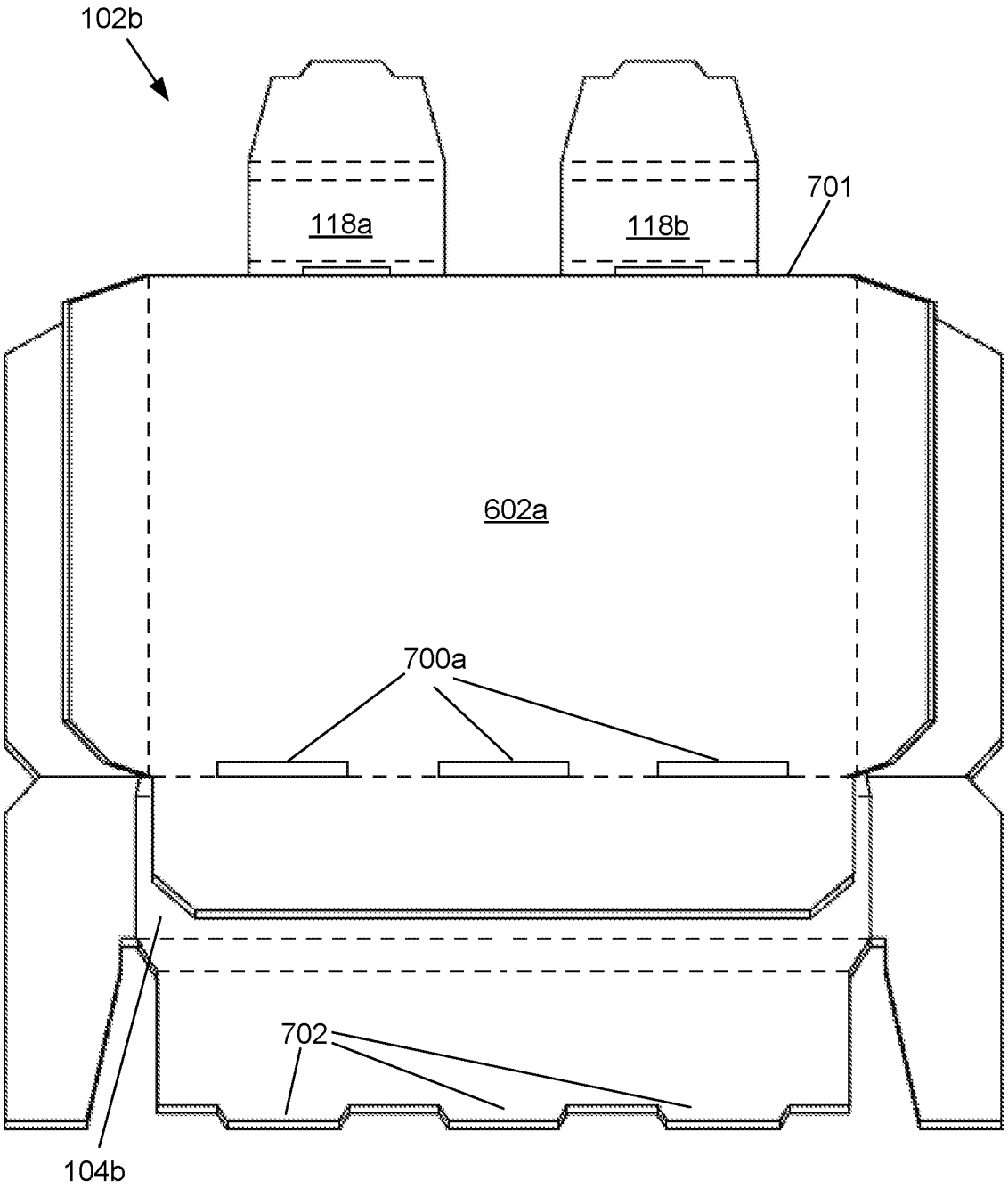
FIG. 9 illustrates a perspective view of the second shelf in a partially assembled state relative to the state illustrated in FIG. 8.

Referring now to FIG. 9, this figure is a perspective view of the second shelf 102*b* in a partially assembled state relative to the state illustrated in FIG. 8 according to an exemplary embodiment. In this exemplary embodiment, the first panel member 602*a* has completed its rotation around seam 701 such that it completely covers the second panel 602*b*. The first set of slots 700*a* of the first panel member 602*a* are in full and substantial alignment with the second set of slots 700*b* of the second panel 602*b*, compared to the position illustrated in FIG. 8. Since the first set of slots 700*a* are in complete alignment with the second set of slots 700*b*, then only the first set of slots 700*a* are visible (and shown, second set of slots 700*b* are not visible in FIG. 9).

Figure 10:
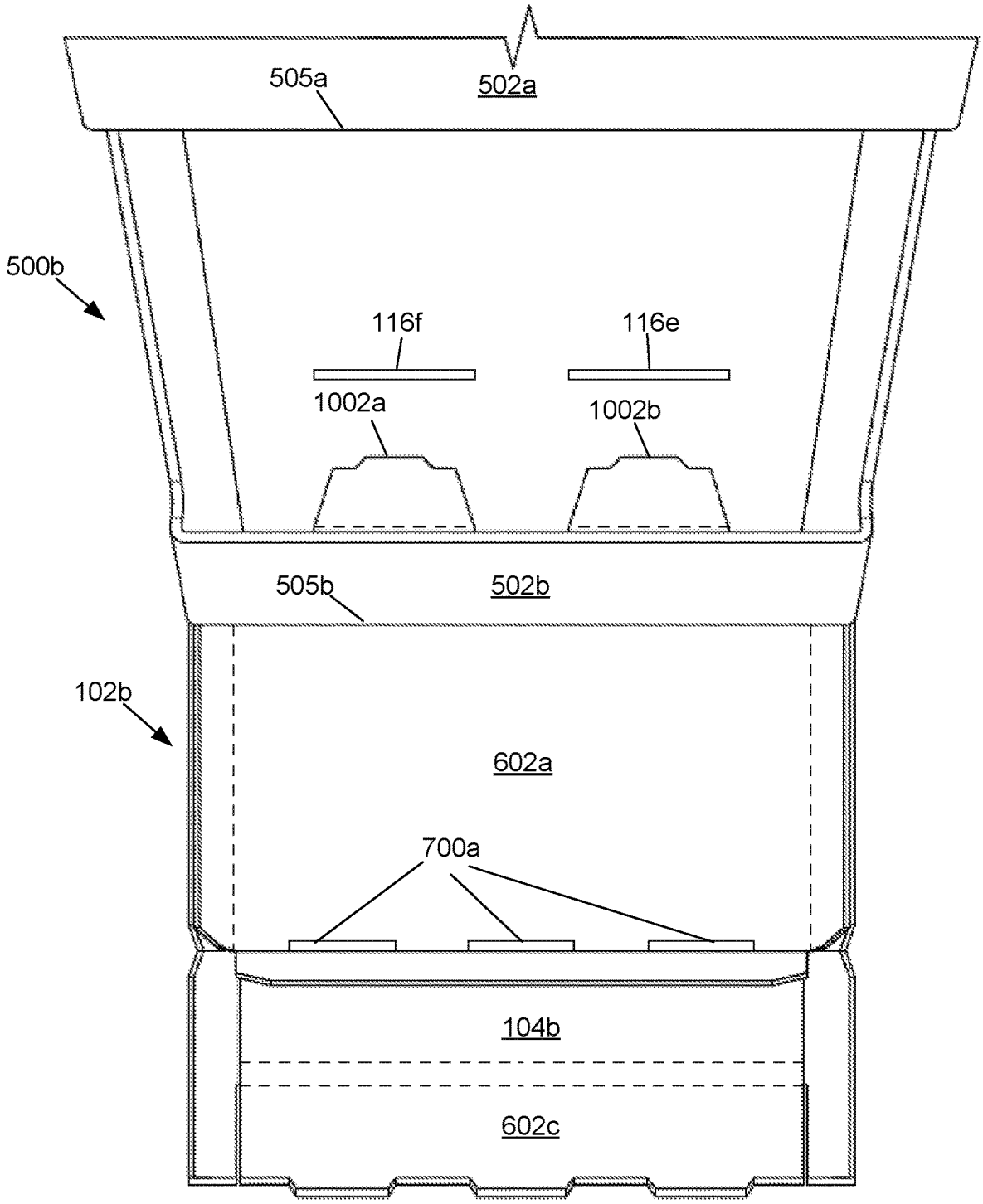
FIG. 10 this figure is a perspective view of the partially assembled second shelf from FIG. 9 being inserted into the first aperture of the stacker display for partial (intermediate) assembly of the system.

Referring now to FIG. 10, this figure is a perspective view of the partially assembled second shelf 102*b* from FIG. 9 being inserted into the first aperture 500*b* of the stacker display 100. The first panel member 602*a* of the second shelf 102*b* is moved under the bottom edge 505*b* of the cross-bar 502*b*. Ends 1002*a*, 1002*b* of tabs 118*a*, 118*b* are directed towards and are aligned with slots 116*e*, 116*f*, where end 1002*a* is aligned with slot 116*f* and end 1002*b* is aligned with slot 116*e*.

Figure 11:
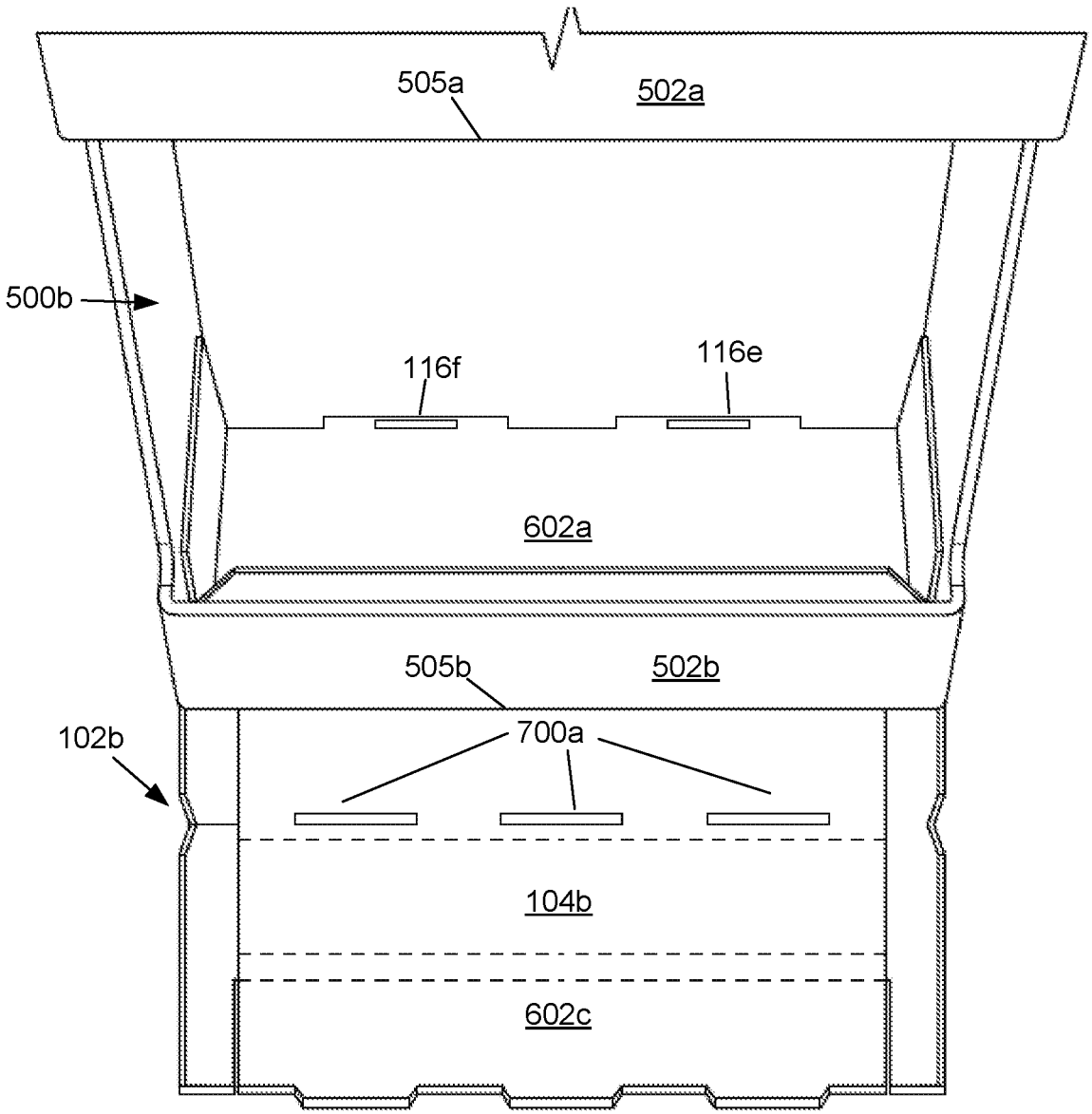
FIG. 11 is a perspective view of the partially assembled second shelf relative to FIG. 10 and it is being further inserted into the first aperture of the stacker display 100.

Referring now to FIG. 11, this figure is a perspective view of the partially assembled second shelf 102*b* relative to FIG. 10 and being further inserted into the first aperture 500*b* of the stacker display 100. Relative to FIG. 10, the ends 1002*a*, 1002*b* of tabs 118*a*, 118*b* are no longer visible since they have been inserted into respective slots 116*f*, 116*e*. The entire surface of first panel member 602*a* continues to move into the volume under the lower end 505*b* of the cross-bar 502*b*.

Figure 12:
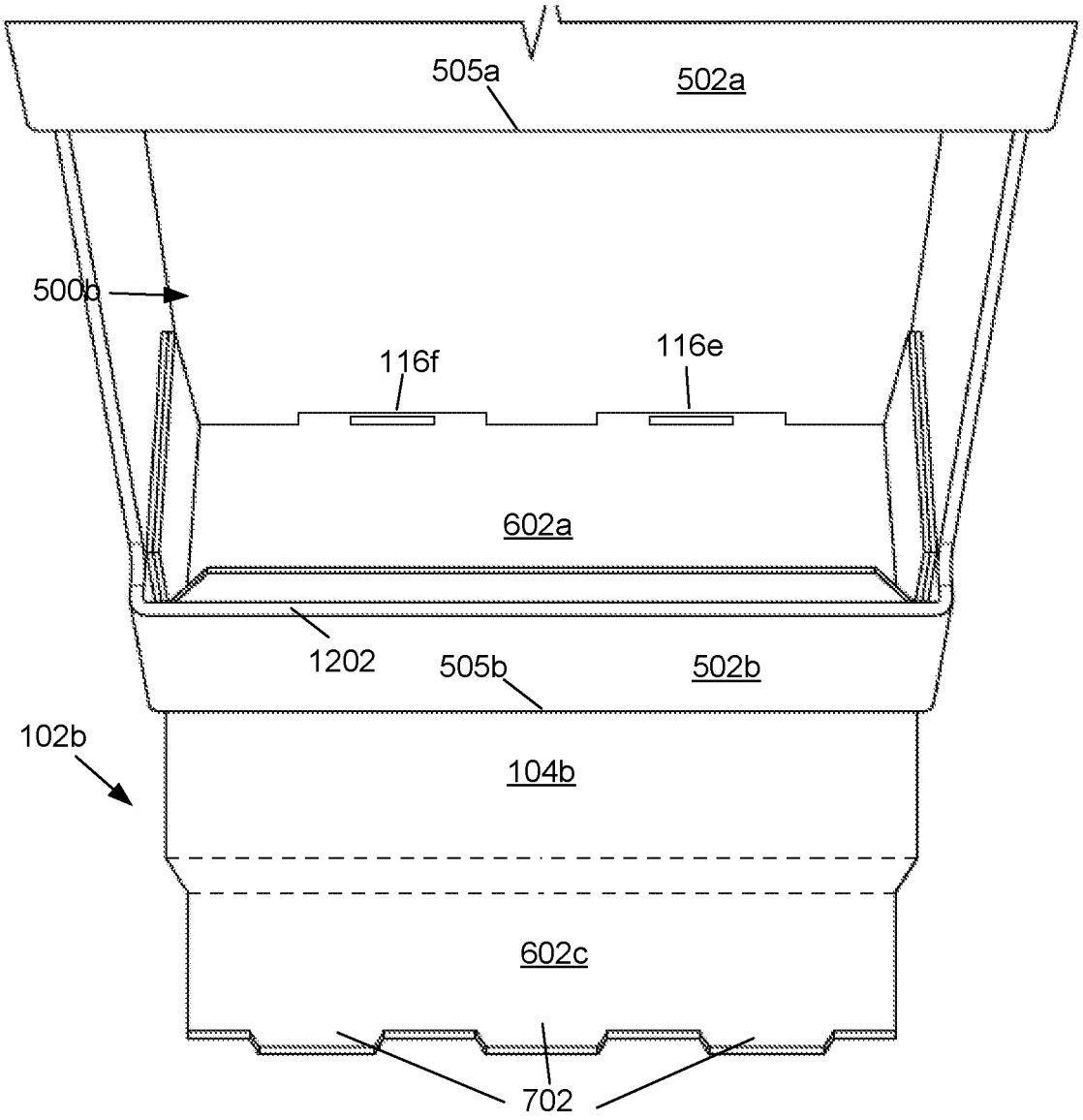
FIG. 12 is a perspective view of the partially assembled second shelf relative to FIG. 11 and being further inserted into the first aperture of the stacker display.

Referring now to FIG. 12, this figure is a perspective view of the partially assembled second shelf 102*b* relative to FIG. 11 and being further inserted into the first aperture 500*b* of the stacker display 100. Relative to FIG. 11, the slots 700*a* which were previously visible in FIG. 11 are no longer visible in FIG. 12 since they have been moved into the volume and under the lower end 505*b* of the cross-bar 502*b*. The tabs 702 may now be moved towards the cross-bar 502*b* so that the tabs 702 and the third panel 602*c* can be moved over a top edge 1202 of the cross-bar 502*b*. Similarly, the front facing member 104*b* may be folded/rotated around the lower edge 505*b* as will be illustrated in FIG. 13 described below.

Figure 13:
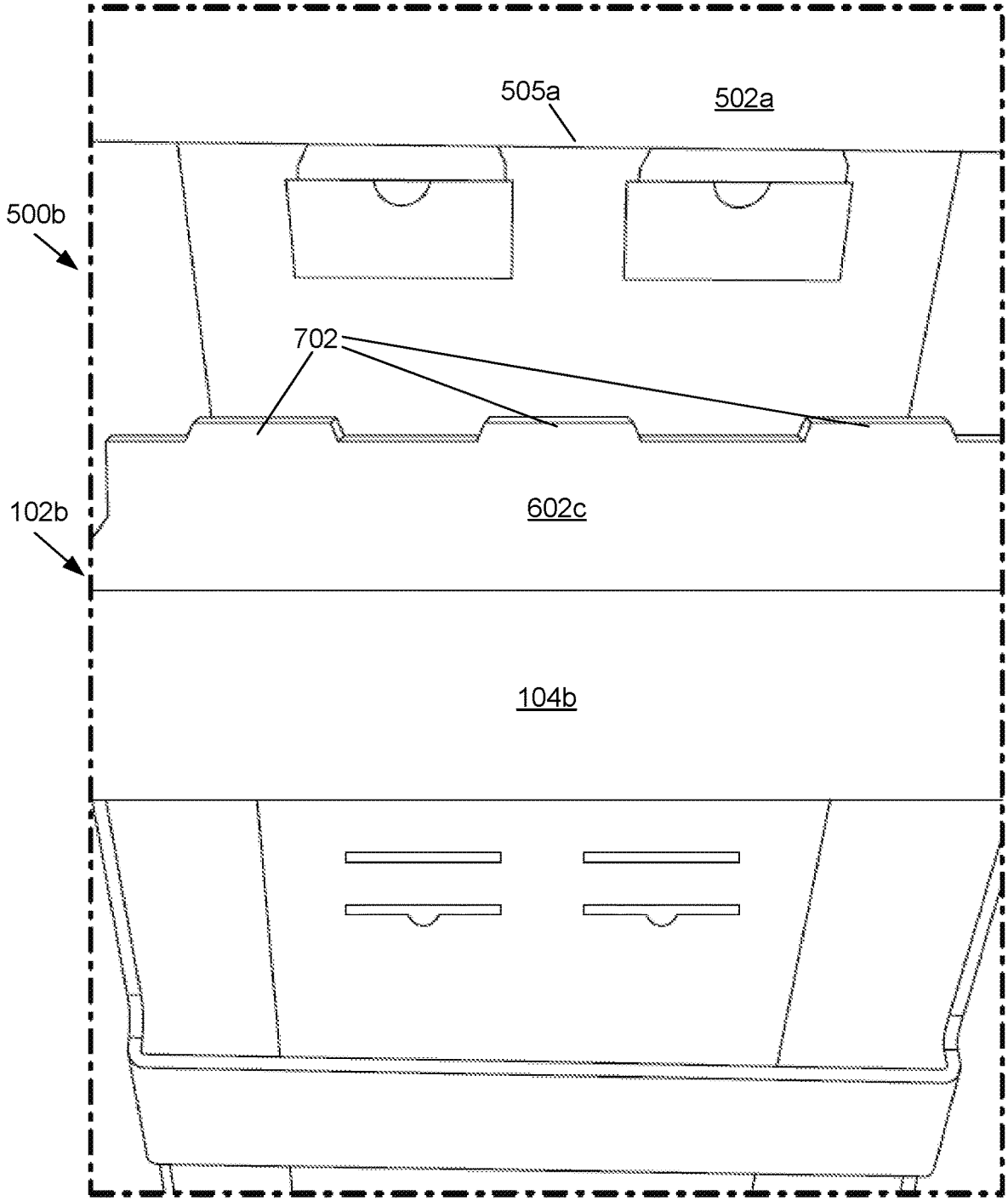
FIG. 13 is a perspective view of the partially assembled second shelf relative to FIG. 12 where the third panel and the tabs have been rotated over the top edge (not visible in FIG. 13) of the cross-bar.

Referring now to FIG. 13, this figure is a perspective view of the partially assembled second shelf 102*b* relative to FIG. 12 where the third panel 602*c* and the tabs 702 have been rotated over the top edge 1202 (not visible in FIG. 13) of the cross-bar 502*b*. Relative to FIG. 12, third panel 602*c* has been rotated around the cross-bar 502*b* (not visible) such that front facing member 104*b* is now positioned over the cross-bar. The front facing member 104*b* may support printed or engraved materials 106 as discussed above and shown in FIG. 1. In the view illustrated in FIG. 13, the third panel 602*c* is in a vertical position and is folded long the top edge 1202 (not visible) of the cross-bar/top portion of front facing member 104*b*.

Figure 14:
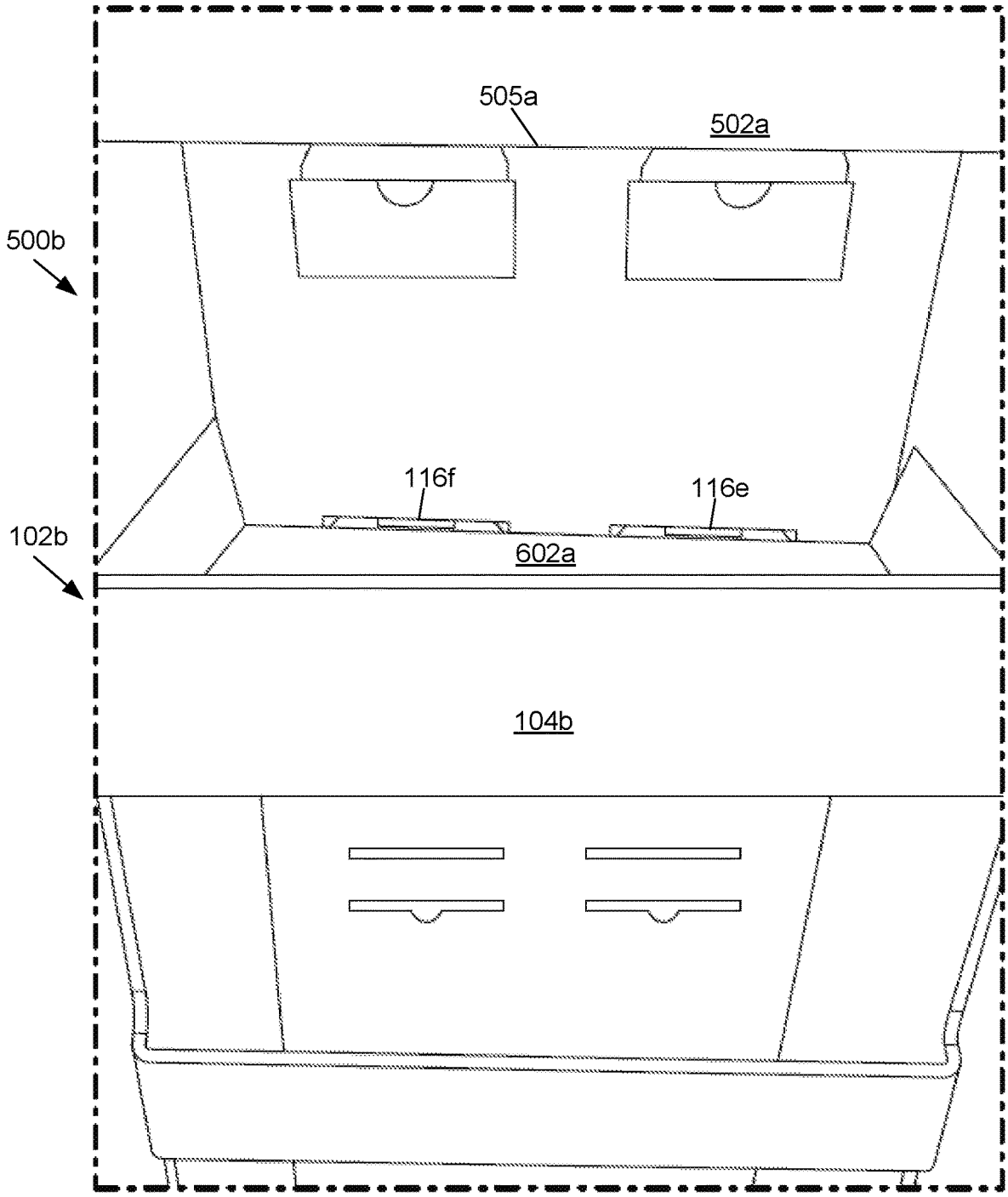
FIG. 14 is a perspective view of the partially assembled second shelf relative to FIG. 13 where the third panel and the tabs have been rotated over the top edge (not visible in FIG. 14) and now the tabs have engaged the slots (not visible)

Referring now to FIG. 14, this figure is a perspective view of the partially assembled second shelf 102*b* relative to FIG. 13 where the third panel 602*c* and the tabs 702 have been rotated over the top edge 1202 (not visible in FIG. 14) and now the tabs have engaged the slots 700*a* (not visible). Relative to FIG. 13, the tabs 702 are no longer visible, but they have been rotated over the cross-bar 502*b* (not visible), where the front facing member 104*b* is now contacting and covering/enveloping the cross-bar 502*b* (not visible). The three tabs 702 have engaged the three slots 700*a* which are present in the first panel member 602*a* (which is folded on top of the second panel member 602*b*).

Figure 15:
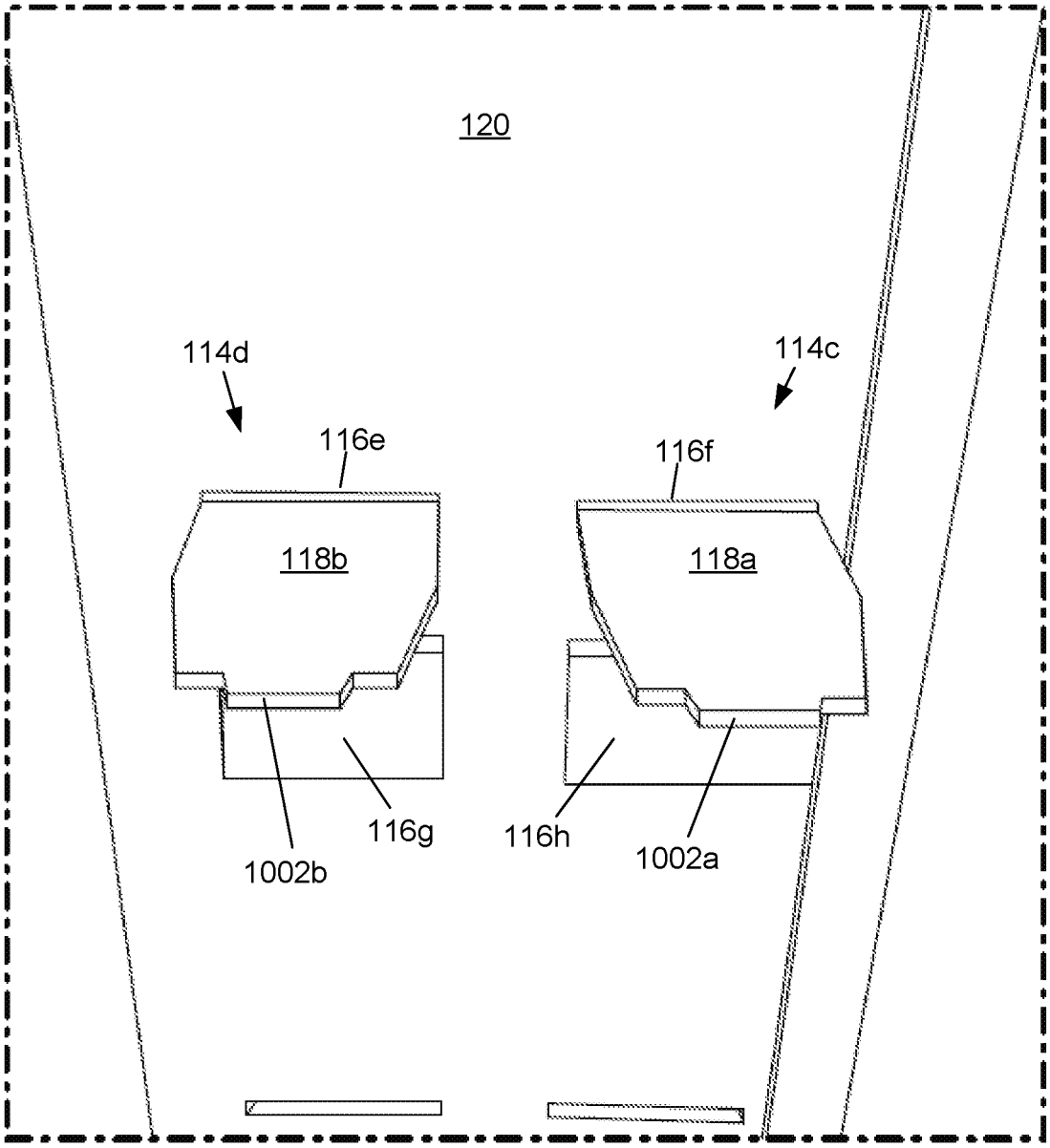
FIG. 15 illustrates a rear, perspective view for third and fourth locking tab systems.

Referring now to FIG. 15, this figure illustrates a rear, perspective view for third and fourth locking tab systems 114*c*, 114*d*. As described previously, each locking tab system 114*c*, 114*d* comprises an upper slot 116*e* or 116*f* and a lower slot 116*g* or 116*h*. The locking tab systems 114*c*, 114*d* further comprise locking tabs 118*a*, 118*b* which extend from the second shelf 102*b* as illustrated in the prior figures. In the embodiment of FIG. 15, the tabs 118*a*, 118*b* have been inserted through the upper slots 116*e*, 116*f*. However, they have not been inserted into lower slots 116*g*, 116*h*.

Figure 16:
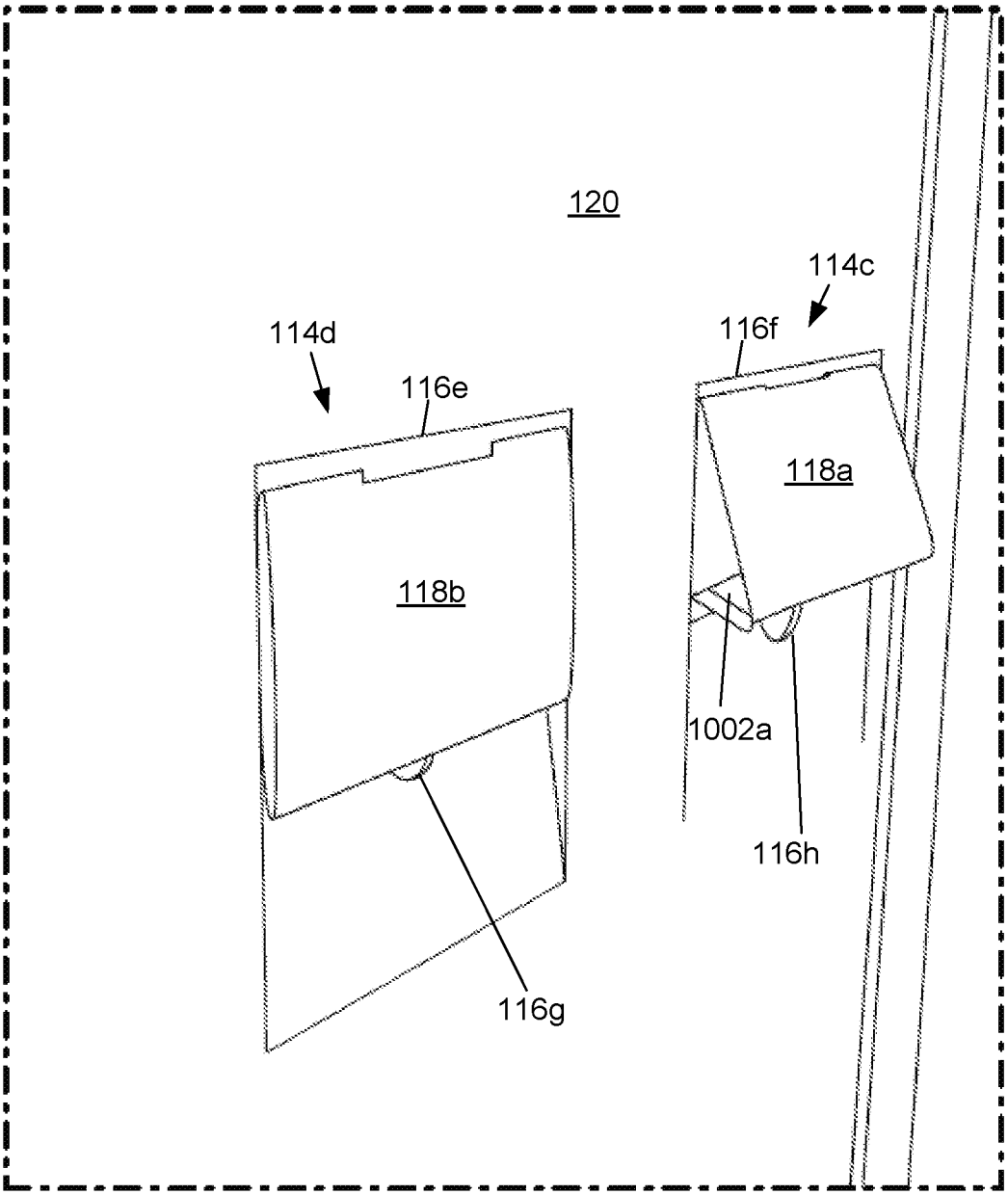
FIG. 16 illustrates further assembly of the locking tab systems that are illustrated in FIG. 15.

Referring now to FIG. 16, this figure illustrates further assembly of the locking tab systems 114*c*, 114*d* that are illustrated in FIG. 15. Relative to FIG. 15, the end 1002*b* of the locking tab 118*b* has been inserted into the lower slot 116*g*. The end 1002*a* of locking tab 118*a* has just started its insertion into lower slot 116*h*.

Figure 17:
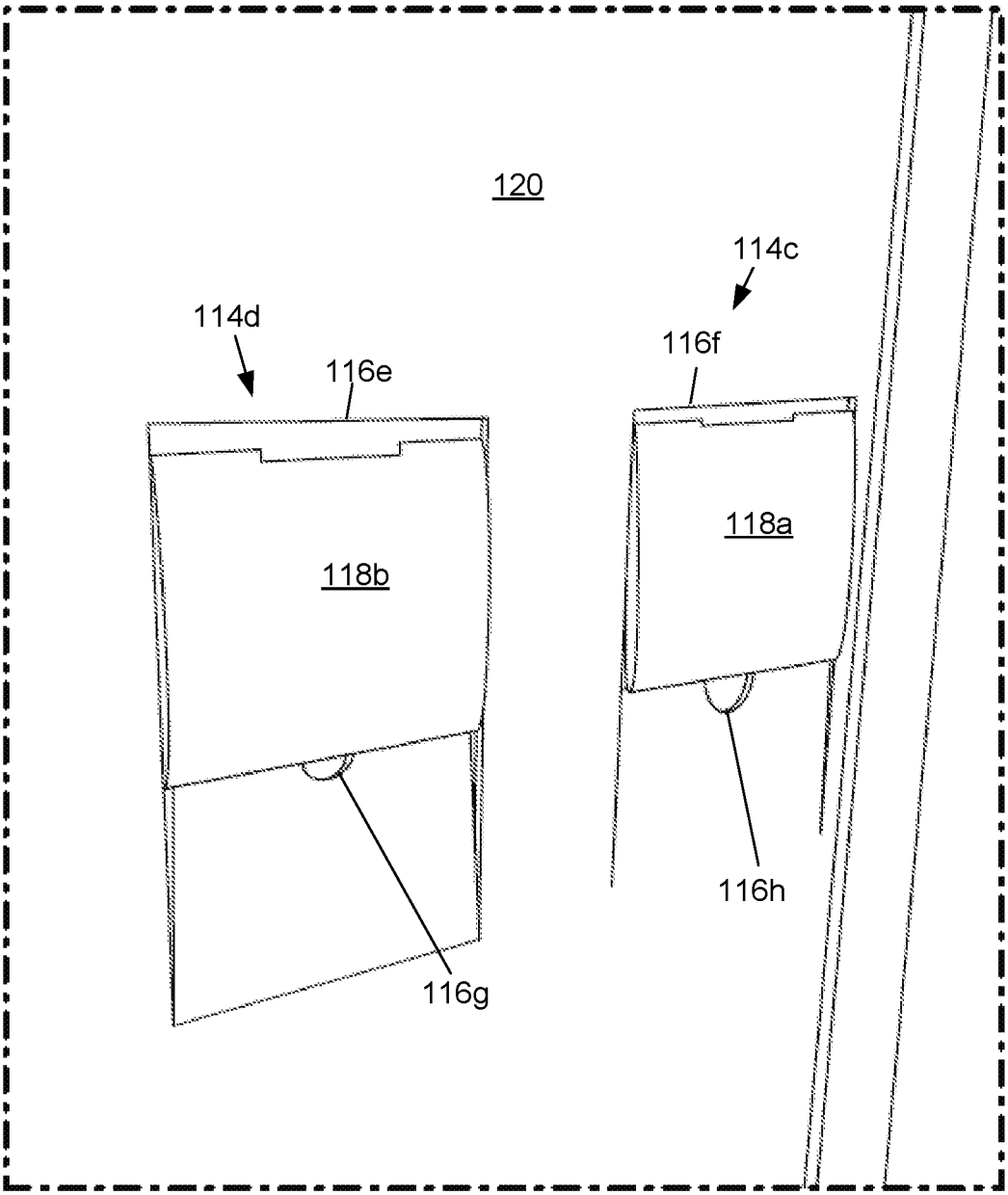
FIG. 17 illustrates further assembly of the locking tab systems that are illustrated in FIG. 16.

Referring now to FIG. 17, this figure illustrates further assembly of the locking tab systems 114*c*, 114*d* that are illustrated in FIG. 16. Relative to FIG. 16, the end 1002*a* of locking tab 118*a* been fully inserted into lower slot 116*h*, such that the two locking tab systems 114*c*, 114*d* are in a fully assembled state as illustrated in FIG. 17.

Figure 18:
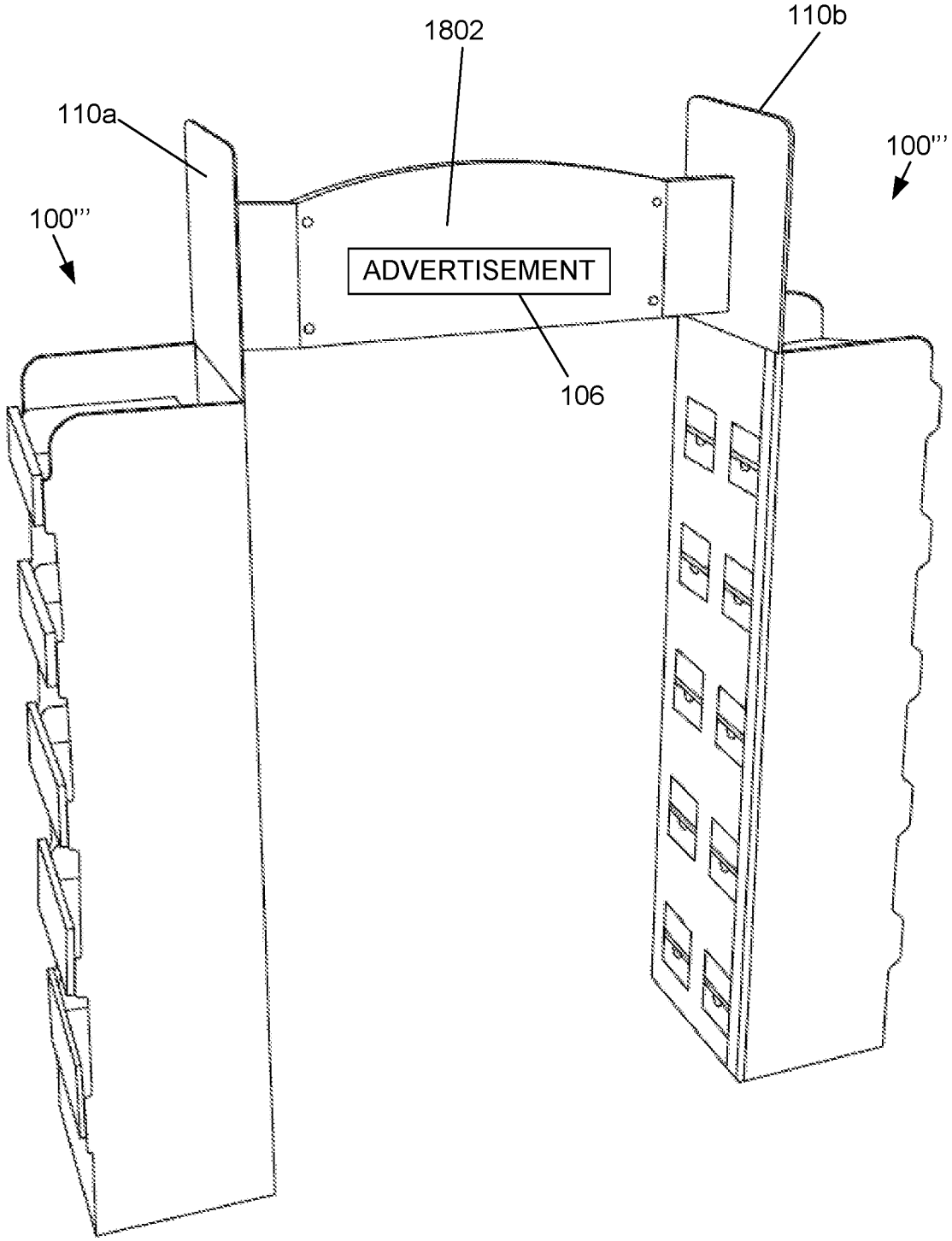
FIG. 18 illustrates an alternative exemplary embodiment where two shelf stacker displays are coupled together.

Referring now to FIG. 18, this figure illustrates an alternative exemplary embodiment where two shelf stacker displays 100''' and 100'''' are coupled together. The two shelf stacker displays 100''' and 100'''' are coupled together by a bridge component 1802. The bridge component may comprise cardboard material, similar to that of the stacker displays 100' and 100'. The bridge component 1802 may be coupled to each display plate 110*a*, 110*b* of a stacker display 100''', 100''''. The bridge component 1802 may be coupled to each display plate 110 by a fastener and/or an adhesive, or combination thereof. The bridge component 1802 may also support printed or engraved materials 106.

Referring now to FIG. 19, this figure illustrates a side, perspective view of the shelf stacker display 100 in a partially assembled state. As noted previously, only one shelf, the first shelf 102*a* has been installed in this exemplary embodiment. The front facing member 104*a* of the first shelf 102 wraps around the first cross-bar 502*a* shown with dashed lines 505*a*, 502*a*1 since cross-bar 502*a* is hidden from actual view when the front facing member 104*a* is present. FIG. 19 further illustrates how the fifth cross-bar 502*e* is separated into its two sections 502*e*1 and 502*e*2 so that the fifth shelf 102*e* may be received and its front facing member 104*e* can wrap around the two sections 502*e*1, 502*e*2.

Figure 20:
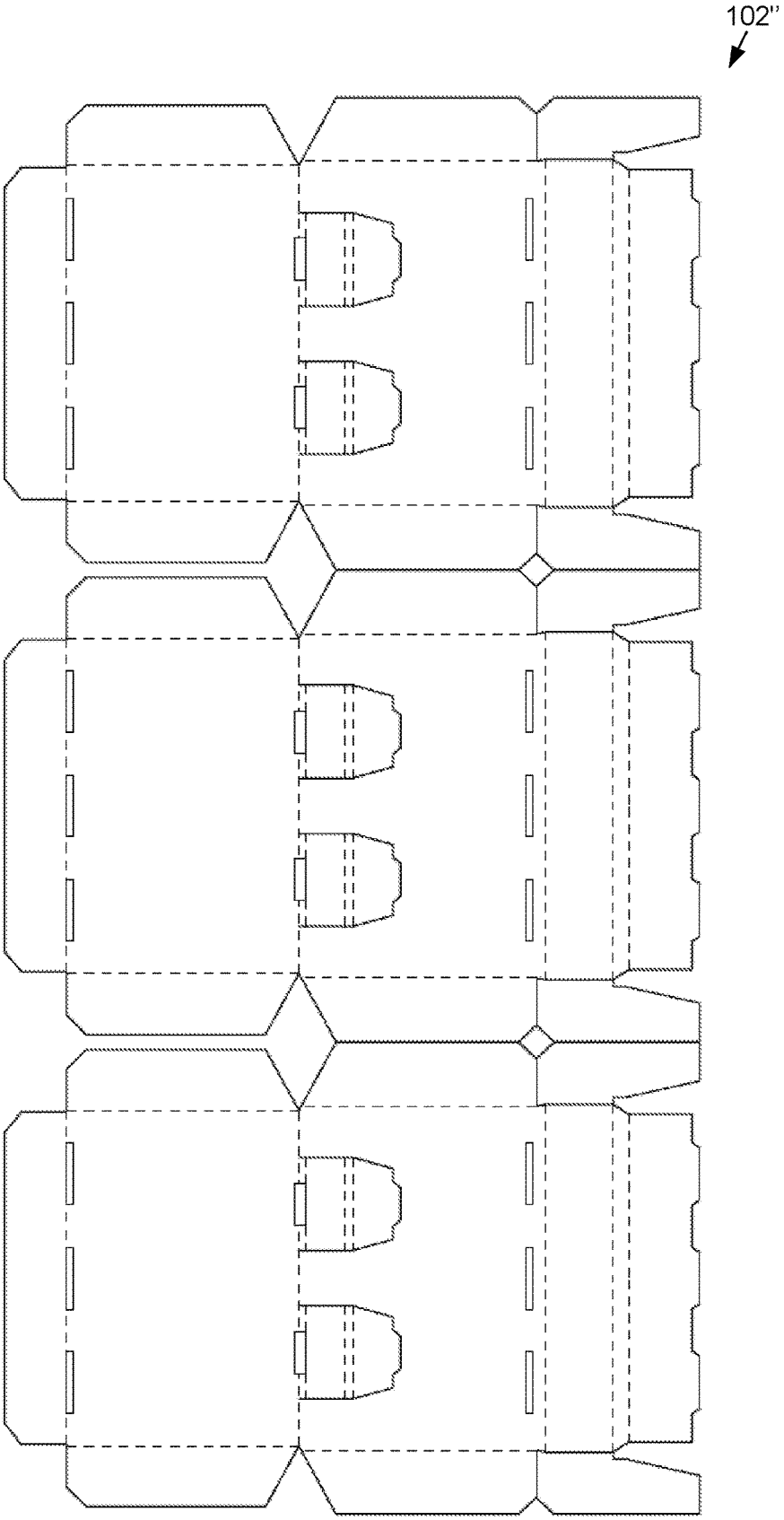
FIG. 20 illustrates a die-cut template drawing for the several shelves which may be manufactured together efficiently from a single sheet of cardboard.

Referring now to FIG. 20, this figure illustrates a die-cut template drawing for the several shelves 102" which may be manufactured together efficiently. According to this exemplary embodiment, three shelves 102" may be manufactured efficiently from a panel or single sheet of cardboard.

Although a few embodiments have been described in detail above, those skilled in the art will readily appreciate that many modifications are possible in the embodiments without materially departing from this disclosure. Accordingly, such modifications are intended to be included within the scope of this disclosure as defined in the following claims. In the claims, means-plus-function clauses are intended to cover the structures described herein as performing the recited function and not only structural equivalents, but also equivalent structures.

Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, sixth paragraph for any limitations of any of the claims herein, except for those in which the claim expressly uses the words 'means for' together with an associated function.

Therefore, although selected aspects have been illustrated and described in detail, it will be understood that various substitutions and alterations may be made therein without departing from the spirit and scope of the present invention, as defined by the following claims.

What is claimed is:

1. A point of sale shelf stacker display system, the system comprising:

at least one shelf component comprising a bottom surface, a front facing member extending away from a first edge of the bottom surface, and at least one tab extending away from a second edge of the bottom surface, wherein the first edge of the bottom surface and the second edge of the bottom surface are parallel; and a shelf supporting frame comprised of:

a front wall defined by a plurality of apertures and cross-bars;

a rear wall for supporting one or more tab locking systems; and two side walls coupled to the front wall and the rear wall;

wherein the front wall cross-bars, rear wall and two side walls of the shelf supporting frame are integrally connected via creases in a single sheet of material;

wherein the at least one tab of the at least one shelf component is received into a given tab locking system supported by the rear wall of the shelf supporting frame; and wherein the front facing member of the at least one shelf component is wrapped around a first given cross-bar of the front wall of the shelf supporting frame.

2. The system of claim 1, wherein the given tab locking system comprises an upper slot and a lower slot positioned within the rear wall.

3. The system of claim 2, wherein the at least one tab of the at least one shelf component exits the upper slot and enters the lower slot.

4. The system of claim 1, wherein the at least one shelf component is made from a single sheet of material.

5. The system of claim 1, wherein the front wall comprises a kick plate and a second given cross-bar adjacent to the kick plate is formed by two members.

* * * * *